US005094547A

United States Patent [19]

Graham

[11] Patent Number: 5,094,547

[45] Date of Patent: Mar. 10, 1992

[54] INTEGRATED CONTAINER FOR MEAT PRODUCTS

[76] Inventor: Mark S. Graham, 4037 Town Park Pl., Sioux Falls, S. Dak. 57105

[21] Appl. No.: 718,003

[22] Filed: Jun. 20, 1991

Related U.S. Application Data

[63] Continuation-in-part of Ser. No. 236,190, Aug. 25, 1988, Pat. No. 5,028,147.

[51] Int. Cl.[5] ..... B65D 33/02

[52] U.S. Cl. ..... 383/119; 220/449; 220/462; 229/117.06; 229/920

[58] Field of Search ..... 229/117.05, 117.06, 229/920, DIG. 4; 383/119; 220/403, 460, 461, 449, 462, 416, 418

[56] References Cited

U.S. PATENT DOCUMENTS

| | | | |
|---|---|---|---|
| 1,374,473 | 4/1921 | Scotcher | 229/920 |
| 2,179,555 | 11/1939 | Kells | 229/920 |
| 3,193,176 | 7/1965 | Gullickson | 229/117.06 |
| 3,232,516 | 2/1966 | Arslanian | 229/920 |
| 4,622,693 | 11/1986 | Mykleby | 383/119 |
| 5,028,147 | 7/1991 | Graham | 383/119 |

FOREIGN PATENT DOCUMENTS

| | | | |
|---|---|---|---|
| 246983 | 2/1911 | Fed. Rep. of Germany | 229/117.05 |
| 2279624 | 2/1976 | France | 229/117.05 |
| 2091217 | 7/1982 | United Kingdom | 229/117.06 |
| 2137170 | 10/1984 | United Kingdom | 229/117.06 |

*Primary Examiner*—Gary E. Elkins
*Attorney, Agent, or Firm*—Gipple & Hale

[57] ABSTRACT

The invention is an integrated container structure in which a sealable envelope of flexible material such as plastic, has disposed within it a carton of semi-rigid material which is bonded to the interior of the envelope at one or more places. The carton consists of a sheet of carton material having appropriate fold lines and configuration to be erected or collapsed into a generally flat structure within the envelope. The invention is particularly useful for the shipment of animal products containing bones and has the advantages that it can be stored in a flat configuration and easily erected into an upright carton within the envelope by simple manipulative procedures.

7 Claims, 1 Drawing Sheet

INTEGRATED CONTAINER FOR MEAT PRODUCTS

CROSS REFERENCE TO RELATED PATENT APPLICATION

This application is a continuation-in-part of application Ser. No. 07/236,190 filed Aug. 25, 1988 now U.S. Pat. No. 5,028,147 issued Jul. 2, 1991.

SUMMARY OF THE INVENTION

The present invention is concerned with an integrated, air-tight container for shipment of goods, which is essentially a pre-formed and joined erectable carton disposed within and adhered to the interior of an air-tight envelope or bag of flexible material so that the container can be stored in a flat configuration and the carton erected for use within the envelope. The carton comprises a sheet of carton material having a rectangular base and a plurality of side and end panels which partially overlap and are joined to adjacent panels to form the side enclosure of the carton with appropriate hinge lines to permit erection of the carton within the enclosing envelope. The present invention is especially adapted for shipment of bones and animal products containing bones under vacuum.

BACKGROUND OF THE INVENTION

The shipment of animal products containing bones poses a unique problem which requires specialized packaging devices and techniques. It is first of all desirable to ship the animal products in inexpensive, air-tight containers to avoid the dissemination of odors or contamination. Plastic bags are one ideal form of containment in most respects since the plastic is air-tight and can be easily sealed. Further, plastic bags are relatively inexpensive and easy to handle and store. Unfortunately, the bones contained in animal products themselves are often sharp and capable of rupturing a plastic bag. For this reason, it is frequently the practice to place the animal products in a receptacle having semi-rigid and less easily penetrated walls such as a cardboard carton. It has, according, become the practice to ship these products in containers known as "bone shields" which are essentially cardboard cartons that are placed within a larger enclosing plastic bag. Since large numbers of these enclosures must be frequently used, it is obviously desirable to be able to store them in a compact manner. At the same time, it is equally desirable that the bags and boxes form an integrated, easily assembled and erected unit so that valuable time is not lost in erecting and preparing each bone shield for use.

It has been suggested in the prior art to provide sealable plastic bags having contained therein disassembled cartons which require extensive assembling before they are erected and ready for use. It is also known to provide previously erected, ready to use cartons which can be inserted into plastic envelopes of suitable size, but these units are difficult and bulky to store.

It is accordingly, and object of the present invention to provide a pre-formed collapsible bone shield which is contained within an enveloping plastic bag. It is another object of the present invention to provide a bone shield system which prevents bones from penetrating and rupturing the enclosing air-tight or vacuum sealed bag. It is a further object of the present invention to provide an easily erectable bone shield system for the shipment of animal products containing bones which can be stored in a collapsed, flat configuration, but which can be erected for use by simple manual manipulation of the pre-formed and bonded structure within the enclosing bag.

DETAILED DESCRIPTION OF THE INVENTION AND ACCOMPANYING DRAWINGS

The present invention is directed to a unique, integrated container for shipment of goods such as bones or meat products containing bones under reduced pressure or air-tight conditions which comprises an air-tight envelopes of flexible material such as plastic, which is capable of sustaining a vacuum and a collapsible, but otherwise assembled and bonded carton disposed within the envelope and bonded to the interior of the envelope to form a unitary structure. The carton contained within the air-tight envelope comprises a sheet of carton material having a plurality of panel members which constitute the side walls of the carton with a part of each of the panel members overlapping a portion of the panels adjacent to it when folded and joined together to form the sides of the carton. Appropriate fold lines are provided both on the central base member and the panels to permit collapsing of the carton structure into a flat configuration without removing or detaching it from the enclosing flexible envelope to which it is attached and to permit easy erection of the carton structure into an open carton suitable for receiving and transporting the animal products. To Facilitate erection of the carton small hemispherical cut outs or holes are provided at the intersections of the center fold line of the base member and the end or short side edges of the base. The present invention thereby provides distinct advantages over devices of the prior art by being adapted to be stored as a single integrated unit in a flat configuration while at the same time, being easily unfolded into an erect, box-like configuration by simple manipulative procedures without the need for joining or bonding the respective elements of the carton structure or removing or detaching the carton structure from the enclosing envelope.

The advantages and structure of the present invention will, however, be more completely appreciated by having specific reference to a preferred embodiment thereof illustrated and described herein.

Figure 1:
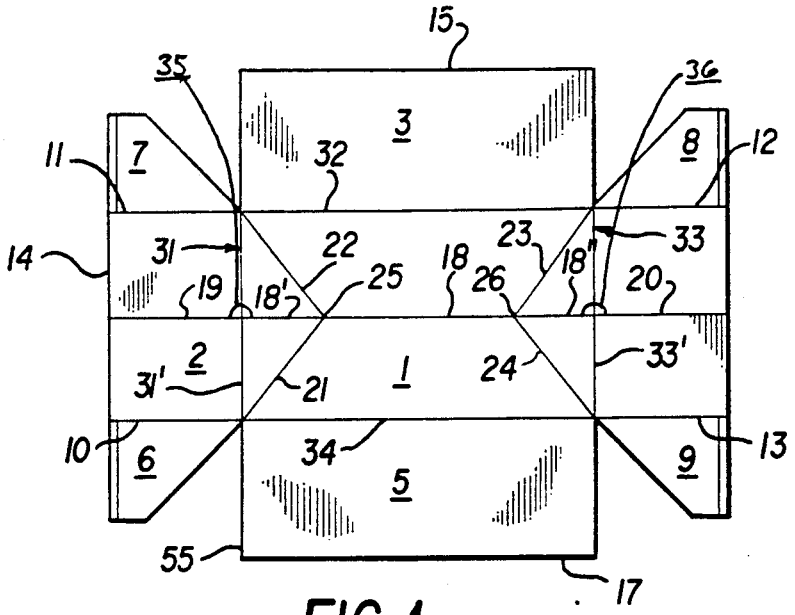
FIG. 1 is a plan view of the unfolded and unbonded blank used to form the erectable carton of the present invention.

Directing attention to FIG. 1 of the drawing, a precut sheet of cardboard or other semi-rigid material having a rectangular base 1 is shown. To each side or edge 31 to 34 of the base 1, a lateral panel 2 to 5 respectively, is hinged. The base and lateral panels are together symmetrical in relation to one of the center line 18. The lateral panels 2 and 4 take the form of isosceles trapezia where the receptable has a rectangular base. In the illustrated embodiment, the two end lateral panels 2 and 4, corresponding to the short edges 31 and 33 of the base 1, have crease lines 10, 11 and 12 13, respectively, to enable these end panels 2 and 4 to be folded and joined, for example, by adhesive to the two other lateral side panels 3 and 5, flaps 6 to 9 intended to be joined to the panels 3 and 5. The flaps 6 to 9 must, of course, be shaped in such a way that they do not extend beyond the lateral panels 3 and 5 when they are folded onto them during assembly.

According to the present invention, in view of the desired flat packing of the assembled package within the enclosing air-tight envelope, the sheet blank illustrated in FIG. 1 of the drawings include a number of prefolded lines. A first fold line runs along the symmetrical crease which constitutes the main center line 18, of the base 1, and its extensions 19 and 20 on the two small end panels 2 and 4. This fold line 18 intersects each short side or edge 31 and 33 of the base dividing that side or edge in half. Semi circular cut outs or small holes are provided at 35 and 36 where the fold line 18 intersects edge 31 and 33 respectively, to facilitate folding and erection for the structure. The blank further contains a number secondary fold lines, 21 to 24 diagonally extending between each apex or corner of the base and intermediate points 25 and 26 on the first lines are extensions for the interior bi-sector angles, each formed by two joining edges of the two neighboring lateral panels, when the latter are folded down along the plane of the base, i.e., when the receptable is in its flat blank state. Diagonal lines 21 and 22 as shown intersect the center line 18 at a point 25 on line 18. Similarly, the secondary, diagonal fold lines 23 and 24 intersect this center line 18 at a point 26 on the latter line. The edges 10 and 55 are angularly spaced apart when the sheet for the receptacle is in its flat blank state, prior to setting up the receptacle, as shown in FIG. 1, and are combined to become one and the same when the receptacle is assembled.

Figure 2:
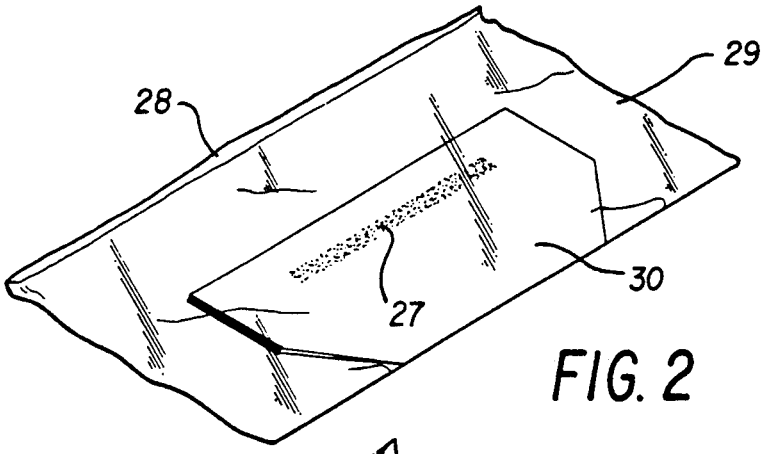
FIG. 2 is a perspective view of the assembled, but collapsed flat carton of the invention within an enclosing plastic bag.
Figure 3:
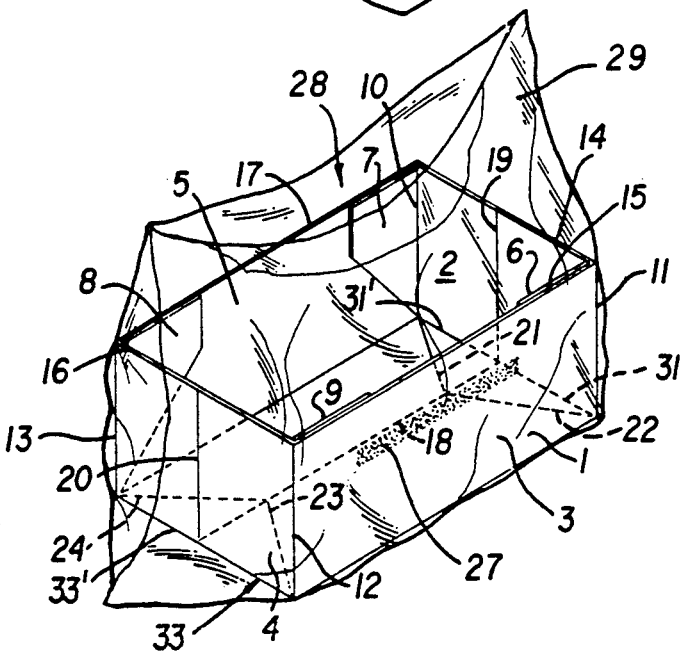
FIG. 3 is a perspective view of the erected carton of the present invention within the enclosing plastic bag.

The assembled and bonded carton can be flattened or collapsed as shown in FIG. 2 of the drawings, and can be folded or set up within its enclosing envelope as shown in FIG. 3 of the drawings. To collapse the carton, the end panels 2 and 4 are respectively folded along lines 19, 18, and 20, 18'' towards the inside of the box. This operation makes the base 1 close outward upon itself. Erecting of the carton from its flat configuration is easily and quickly accomplished, essentially by applying outward pressure to the fold lines 19, 20 31, 31'', 33, 33'' and then creasing the intersection of the panels 3 and 5 with the base member 1 along lines 32 and 34 respectively. The erection procedure for collapsing the already erected structure, is easily accomplished within the enclosing plastic envelope requires no additional bonding of the respective parts of the pre-formed blank.

The carton structure is adhered to the interior of the flexible, air-tight pouch or envelope by means of a suitable adhesive applied to panels 3 and 5. This adhesive maintains the carton in the correct position within the enclosing envelope so that it is ready upon erection to receive its intended contents. Final closure of the system is conveniently achieved by heat sealing the opening 28 of the plastic bag 29 as illustrated in FIG. 2 of the drawings.

The carton of the present invention is conveniently made of flexible pasteboard having sufficient strength to substantially prevent penetration by bones carried within the carton. It is also convenient to coat one or both sides of the cardboard material with a moisture impervious material to prevent the cardboard from soaking up or adhering to fluids released by the bones or attached meat. The enclosing envelope is typically made of a suitable polymeric material such as polyethylene.

While a preferred embodiment of the present invention has been described herein for illustrative purposes, it will be apparent to those of ordinary skill in the art that the scope of the present invention is considered to include other embodiments and alternatives.

I claim:

1. An integrated container structure comprising a sealable envelope of flexible material having disposed therein a carton of semi-rigid carton material, said carton being bonded to the interior of said envelope at one or more places and comprising a sheet of said material having appropriate fold lines and configuration to be erected into an upright structure or collapsed into a generally flat structure within said envelope; said sheet comprising a central rectangular base member having a central longitudial fold line and a plurality of panels respectfully disposed at the sides and ends of said base member with a system of hinge lines and fold lines to permit erecting or collapsing of said carton; said panels partially overlapping one another and being bonded thereto at adjacent points to form the sides of the carton, and apertures being disposed at the respective intersections of said central fold line and each of said end panels to facilitate collapsing or erecting said structure.

2. The container structure of claim 1 wherein at least one surface of said carton is coated with a moisture resistant material.

3. The containing structure of claim 1 wherein said flexible envelope is plastic.

4. The container structure of claim 3 wherein said envelope is air-tight when sealed.

5. A container for shipment of goods under reduced pressure comprising in combination: an air tight envelope of flexible material capable of sustaining a vacuum and a collapsible carton disposed therein and adapted to be erected or collapsed within said envelope, said carton comprising a sheet of carton material having a plurality of panel members overlapping a portion of the adjacent panel members when folded and being joined thereto to form the sides of said carton; a rectangular base member constituting a central part of the sheet; a system of hinge lines, each defining a side of one of the panel members and a side of the base member coincident with the panel side to permit folding the panel members about the hinge lines for erecting or collapsing said carton; and a system of fold lines extending over surfaces said base member and several of said panel members, said system including a primary fold line coincident with the center line of the sheet to permit convex folding of said base members, and a number of secondary fold lines extending into the base member, one of said secondary fold lines being between each corner of the base member and a point on the first fold line diagonally spaced from the respective corner said system of fold lines permitting collapsing the erected carton into a flat unit and erecting of said collapsed unit into an erect carton within said envelope; a semi circular aperture being disposed at each of the respective intersections of said primary fold line and an opposing hinge line defining a side of a panel member.

6. A container for shipment of goods comprising in combination: and air tight envelope of flexible material with a collapsible carton disposed within and adhered to thee interior of the envelope, said collapsible carton comprising:

a plurality of panel members constituting walls of a carton, a part of each of said panels members overlapping a portion of the adjacent panel members when folded and being joined thereto to form the sides of said carton; and a convex-polygonal base member extending between substantially coplanar edges of said panel members; said panel and base members having a system of hinge lines, each defining one of said edges of the panel members and a side of the base member coincident therewith, to enable folding the panel members about the hinge lines for setting up the carton; and a system of fold lines extending over surfaces of such members to enable repeated twisting of the respective members relative to the fold lines in the fold lines, for collapsing the carton into a flat unit and for unfolding said unit to reconstitute the carton, said system of fold lines including (a) a primary fold line coinciding with a center line of the base member, (b) a number of secondary fold lines extending into the base member, one between each corner of the base member and a point on the first line diagonally spaced from the respective corner, a semi circular aperture being disposed at each of the intersections of said primary fold line and a fold line along opposing sides of said base member; said system of fold lines permitting collapsing the erected carton into a flat unit and erecting of said collapsed unit into an erect carton within said envelope.

7. The container of claim 1 wherein said envelope is made of plastic and said carton is made of cardboard.

* * * * *